US011408287B2

(12) United States Patent
Wan et al.

(10) Patent No.: US 11,408,287 B2
(45) Date of Patent: Aug. 9, 2022

(54) COMPRESSOR PUMP BODY, COMPRESSOR, AND AIR CONDITIONER WITH A VANE ENLARGEMENT PORTION

(71) Applicant: Gree Electric Appliances, Inc. of Zhuhai, Guangdong (CN)

(72) Inventors: Pengkai Wan, Guangdong (CN); Jia Xu, Guangdong (CN); Wenjiao Sun, Guangdong (CN); Fayou Luo, Guangdong (CN); Fei Wu, Guangdong (CN); Qingfu Zhao, Guangdong (CN); Zhengliang Shi, Guangdong (CN); Jinwei Liu, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 14 days.

(21) Appl. No.: 17/051,628

(22) PCT Filed: Dec. 12, 2018

(86) PCT No.: PCT/CN2018/120674
§ 371 (c)(1),
(2) Date: Oct. 29, 2020

(87) PCT Pub. No.: WO2020/062602
PCT Pub. Date: Apr. 2, 2020

(65) Prior Publication Data

US 2021/0231123 A1 Jul. 29, 2021

(30) Foreign Application Priority Data

Sep. 25, 2018 (CN) ..... 201811119409.X

(51) Int. Cl.
*F01C 21/08* (2006.01)
*F04C 18/344* (2006.01)
*F04C 29/12* (2006.01)

(52) U.S. Cl.
CPC ..... *F01C 21/0809* (2013.01); *F01C 21/0881* (2013.01); *F04C 18/3446* (2013.01); *F04C 29/12* (2013.01)

(58) Field of Classification Search
CPC ..... F01C 21/0809; F01C 21/0881; F04C 18/3446; F04C 29/12
See application file for complete search history.

(56) References Cited

U.S. PATENT DOCUMENTS 462,708 A * 11/1891 Hochhausen ..... F04C 29/12 418/259
8,915,726 B2 * 12/2014 Liang ..... F01C 21/0809 418/146
2014/0271310 A1 * 9/2014 Whitesel ..... F04C 18/3446 418/191

FOREIGN PATENT DOCUMENTS

CN 1162701 A 5/2011
CN 202091193 U 12/2011
(Continued)

OTHER PUBLICATIONS

International Search Report issued in connection with PCT Application No. PCT/CN2018/120674 dated Jun. 24, 2019.

*Primary Examiner* — Mary Davis
(74) *Attorney, Agent, or Firm* — Dennemeyer & Associates, LLC

(57) ABSTRACT

The disclosure discloses a compressor pump body, a compressor and an air conditioner. The compressor pump body includes a sliding vane, a first flange and a second flange. The sliding vane includes a main body. The main body is provided with a first surface and a second surface which are arranged opposite to each other. The first surface abuts against the first flange, and the second surface abuts against the second flange. The first surface and/or the second surface are/is provided with an enlargement portion. An exhaust port
(Continued)

is formed in the first flange and/or the second flange. When the sliding vane rotates to sweep the exhaust port, the enlargement portion can prevent two sides of the sliding vane in the rotation direction from communicating by means of the exhaust port.

17 Claims, 5 Drawing Sheets

(56) References Cited

FOREIGN PATENT DOCUMENTS

| | | | |
|---|---|---|---|
| CN | 103591018 | A | 2/2014 |
| CN | 204419597 | U | 6/2015 |
| CN | 204572458 | U | 8/2015 |
| CN | 208858563 | U | 5/2019 |
| JP | 2016205211 | A | 12/2016 |
| RU | 2419728 | C1 | 5/2011 |

* cited by examiner

COMPRESSOR PUMP BODY, COMPRESSOR, AND AIR CONDITIONER WITH A VANE ENLARGEMENT PORTION

CROSS-REFERENCE TO RELATED APPLICATIONS

This is a 35 U.S.C. 371 National Stage Patent Application of International Application No. PCT/CN2018/120674, filed Dec. 12, 2018, which claims priority to Chinese application 201811119409.X, filed on Sep. 25, 2018 and entitled "Compressor Pump Body, Compressor and Air Conditioner", the contents of each are hereby incorporated by reference in its entirety.

TECHNICAL FIELD

The disclosure relates to a field of air conditioning technology, in particular to a compressor pump body, a compressor and an air conditioner.

BACKGROUND

In the technology known to the inventors, a compressor pump body includes a rotary cam, a cylinder block, a sliding vane, an upper flange, and a lower flange, and so on. The upper and lower flanges close upper and lower ends of the cylinder block and form a working chamber of the pump body together with the rotary cam and the cylinder block. The sliding vane between the rotary cam and the cylinder block divides the working chamber into separate suction chamber (low pressure chamber) and exhaust chamber (high pressure chamber). Compressed high pressure gas in the exhaust chamber is discharged through exhaust ports disposed on the upper flange and/or the lower flange. In order to ensure that the sliding vane does not cause gas from mixing up (i.e., gas mixing) between the two chambers in the sliding process (pump body compression), the current size design of the exhaust port usually only ensures that its width in the rotating direction of the sliding vane shall not exceed the thickness of the sliding vane in the rotating direction, and in order to ensure that the existing sliding vane has a small mass inertia, its thickness is often relatively thin, which leads to that the corresponding width of the exhaust port is seriously restricted by the thickness of the sliding vane, and an exhaust area of the exhaust port is insufficient (which will improve the exhaust velocity and reduce the energy efficiency of the compressor). The current solution is arranging multiple exhaust ports on the upper flange or the lower flange, which involves a problem of structure arrangement of the exhaust port; specifically, there are more screw avoiding holes, gas channels, etc. on the upper flange and the lower flange, which will affect the positions of arranging multiple exhaust ports, and will greatly increase the processing cost.

SUMMARY

Therefore, the technical problem to be solved by the disclosure is to provide a compressor pump body, a compressor and an air conditioner. The size of an exhaust port can be increased by using a sliding vane with an enlargement portion, so as to reduce the exhaust velocity and the exhaust loss, improve the energy efficiency of the compressor, and reduce the production cost.

To solve the above problem, the disclosure provides a compressor pump body, which includes a sliding vane, a first flange and a second flange. The sliding vane includes a main body. The main body is provided with a first surface and a second surface which are arranged opposite to each other. The first surface abuts against the first flange, and the second surface abuts against the second flange. The first surface and/or the second surface are/is provided with an enlargement portion. An exhaust port is formed in the first flange and/or the second flange. When the sliding vane rotates to sweep the exhaust port, the enlargement portion can prevent two sides of the sliding vane in the rotation direction from communicating by means of the exhaust port.

In some embodiments, the enlargement portion continuously extends from the first surface to the second surface.

In some embodiments, the main body is further provided with a third surface and a fourth surface which are in the rotating direction and arranged opposite to each other. The enlargement portion includes a protruding portion which protrudes out of the third surface and/or the fourth surface.

In some embodiments, the compressor pump body further includes a cylinder block. The enlargement portion further includes a contact portion, and the contact portion forms a linear contact with the inner wall of the cylinder block.

In some embodiments, the compressor pump body further includes a rotating wheel. A sliding groove is formed in the rotating wheel for accommodating the sliding vane and guiding the sliding of the sliding vane. The opening of the sliding groove is provided with an accommodating portion to accommodate the enlargement portion.

In some embodiments, an assembling clearance between the enlargement portion and the accommodating portion is $\delta$, and $0<\delta\leq 2$ mm.

In some embodiments, $0.1\text{ mm}\leq\delta\leq 0.5\text{ mm}$.

In some embodiments, each of cross sections of the enlargement portion in the radial direction of the first flange is circular, and the shape of the exhaust port is circular.

The disclosure also provides a compressor, which includes the compressor pump body.

The disclosure also provides an air conditioner, which includes the compressor.

According to the compressor pump body, the compressor and the air conditioner provided by the disclosure, because the main body is provided with the enlargement portion, the occupying size of the enlargement portion is greater than the thickness of the main body in its rotation direction, which obviously can design the size of the exhaust port disposed on the first flange and/or the second flange larger without being limited by the thickness of the main body as in the device known to the inventors. In this way, there is no need to arrange more small-size exhaust ports on the first flange and/or the second flange, but using single or fewer large-size exhaust ports in the technical solution, which can greatly reduce the processing difficulty and production cost of the first flange and/or the second flange. By using the sliding vane in the technical solution, the size of the corresponding exhaust port is larger, so the exhaust velocity and the exhaust loss can be reduced, and the energy efficiency of the compressor can be improved.

The reference numbers are as follows:

1. sliding vane; 10. main body; 11. first surface; 12. enlargement portion; 13. third surface; 14. protruding portion; 15. contact portion; 2. cylinder block; 3. first flange; 5. rotating wheel; 51. sliding groove; 52. accommodating portion; S. exhaust port corresponding to the sliding vane of the disclosure; P. exhaust port in the device known to the inventors.

DETAILED DESCRIPTION OF THE EMBODIMENTS

Figure 5:
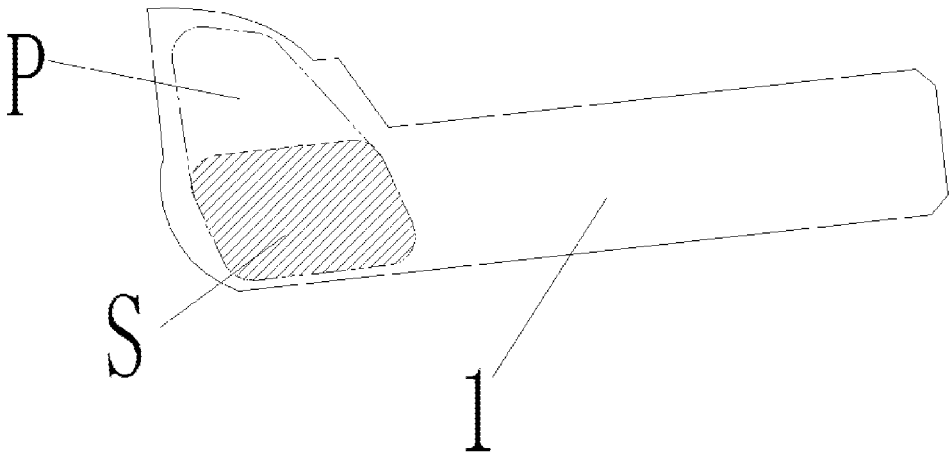
FIG. 5 is a comparison diagram of an exhaust port corresponding to a sliding vane in a compressor pump body according to an embodiment of the disclosure and an exhaust port (shaded part) in the device known to the inventors.
Figure 8:
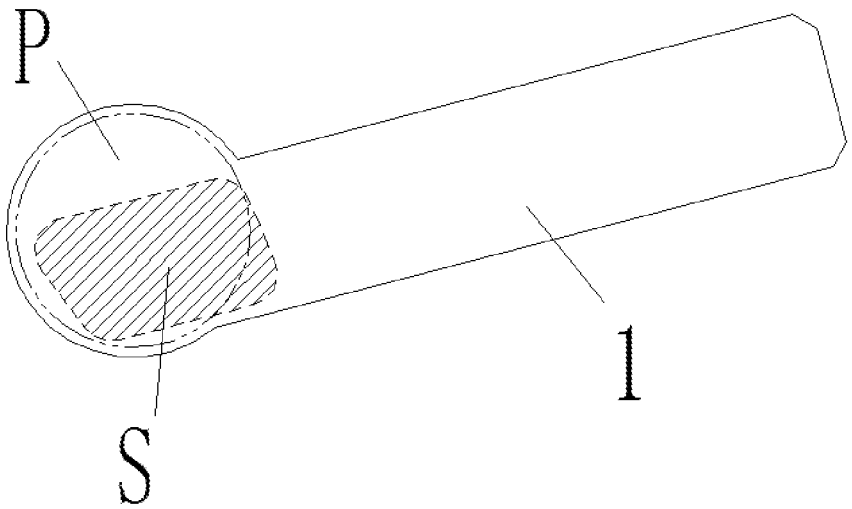
FIG. 8 is a comparison diagram of an exhaust port corresponding to a sliding vane in a compressor pump body according to an embodiment of the disclosure and an exhaust port (shaded part) in the device known to the inventors.

Referring to FIG. 1 to FIG. 8, according to embodiments of the disclosure, a compressor pump body is provided, which includes: a sliding vane 1, a first flange 3, a second flange, a rotating wheel 5 and a cylinder block 2. The first flange 3 and the second flange are respectively located at two axial ends of the cylinder block 2, so as to close the two ends of the cylinder block 2, and an unequal gap is provided between a peripheral wall of the rotating wheel 5 and an inner wall of the cylinder block 2, thus the first flange 3, the second flange, the rotating wheel 5 and the cylinder block 2 from a working chamber of the compressor pump body. The sliding vane 1 is located between the cylinder block 2 and the rotating wheel 5, thereby dividing the working chamber into separate high pressure chamber (exhaust chamber) and low pressure chamber (suction chamber). The sliding vane 1 includes a main body 10. The main body 10 is provided with a first surface 11 and a second surface which are arranged opposite to each other. The first surface 11 abuts against the first flange 3, and the second surface abuts against the second flange. The first surface 11 and/or the second surface are/is provided with an enlargement portion 12. An exhaust port is formed in the first flange 3 and/or the second flange. When the sliding vane 1 rotates to sweep the exhaust port, the enlargement portion 12 can prevent two sides of the sliding vane 1 in its (the sliding vane 1) rotation direction from communicating by means of the exhaust port. In the technical solution, because the main body 10 is provided with the enlargement portion 12, the occupying size of the enlargement portion 12 is greater than the thickness of the main body 10 in its rotation direction, which obviously can design the size of the exhaust port arranged on the first flange 3 and/or the second flange larger (as shown in FIG. 5 or FIG. 8) without being limited by the thickness of the main body 10 as in the device known to the inventors. In this way, there is no need to arrange more small-size exhaust ports on the first flange 3 and/or the second flange, but using single or fewer large-size exhaust ports in the technical solution, which can greatly reduce the processing difficulty and production cost of the first flange 3 and/or the second flange. By using the sliding vane 1 in the technical solution, the size of the corresponding exhaust port is larger, so the exhaust velocity and the exhaust loss can be reduced, and the energy efficiency of the compressor can be improved.

Certainly, the enlargement portion 12 can be provided at any position, between the peripheral wall of the rotating wheel 5 and the inner wall of the cylinder block 2, of the main body 10. The enlargement portion 12 is arranged at one end of the main body 10 toward the inner wall of the cylinder block 2, so that the contradiction existing between the size of the enlargement portion 12 and the interference can be well solved.

Figure 1:
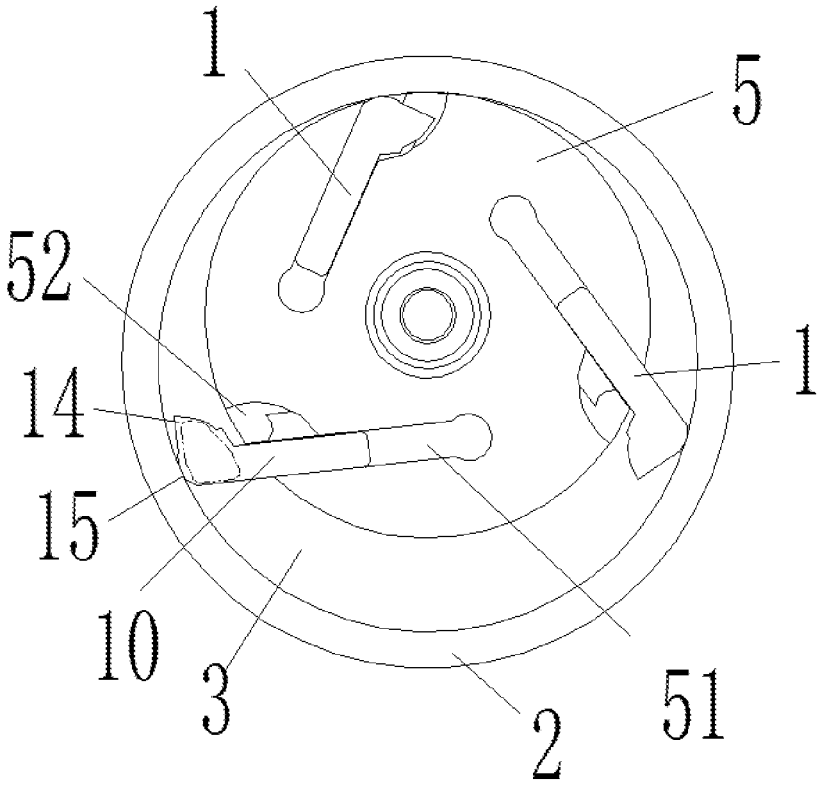
FIG. 1 is an internal structure diagram of a compressor pump body according to an embodiment of the disclosure.
Figure 2:
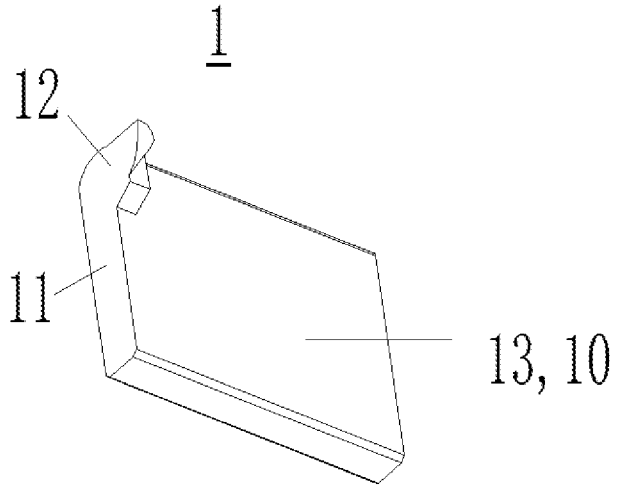
FIG. 2 is a three-dimensional structure diagram of an embodiment of a sliding vane in a compressor pump body according to an embodiment of the disclosure.
Figure 3:
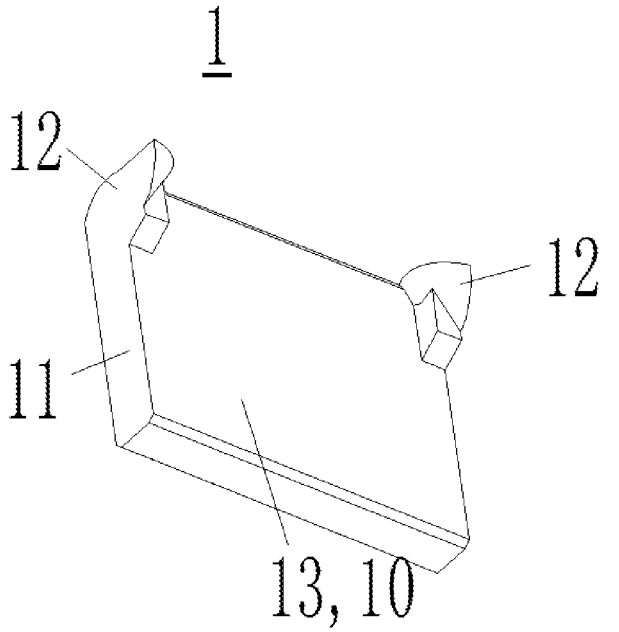
FIG. 3 is a three-dimensional structure diagram of another embodiment of the sliding vane in a compressor pump body according to an embodiment of the disclosure.
Figure 4:
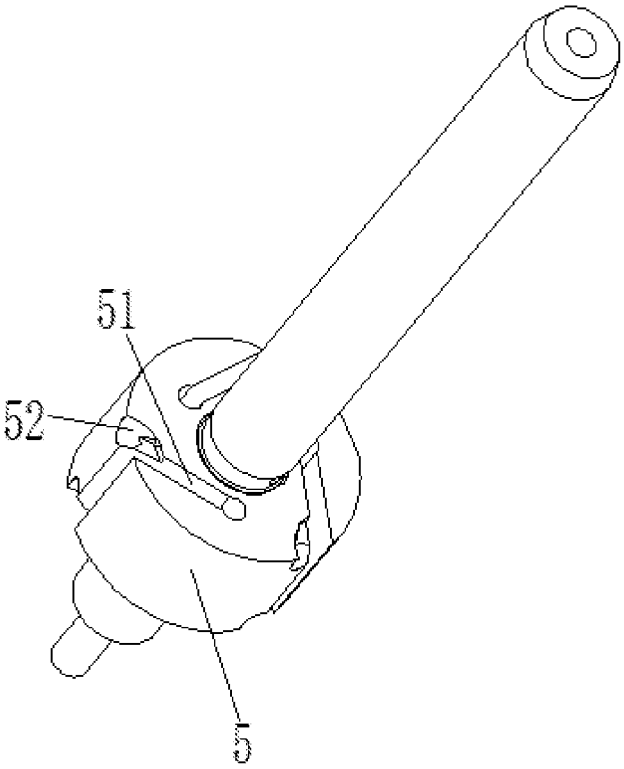
FIG. 4 is a three-dimensional structure diagram of a rotating wheel in a compressor pump body according to an embodiment of the disclosure.
Figure 6:
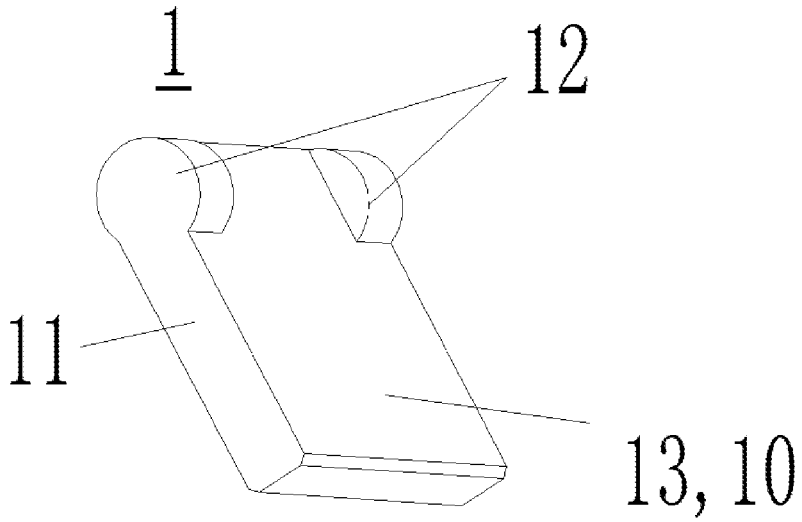
FIG. 6 is a three-dimensional structure diagram of yet another embodiment of the sliding vane in a compressor pump body according to an embodiment of the disclosure.
Figure 7:
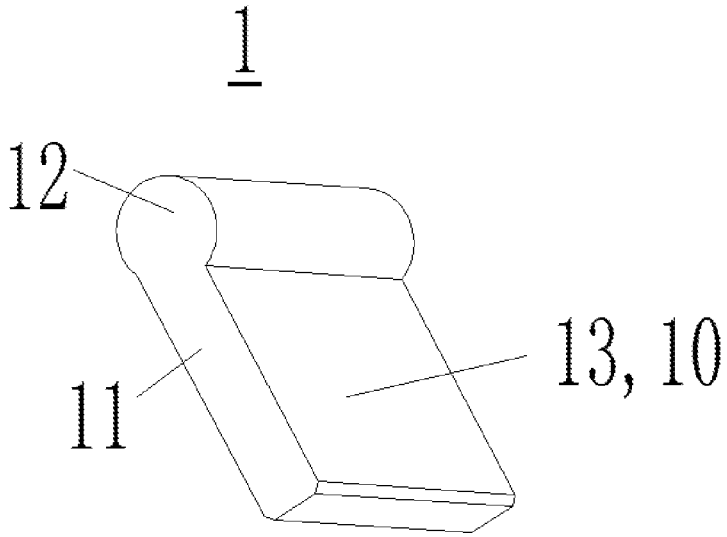
FIG. 7 is a three-dimensional structure diagram of yet another embodiment of the sliding vane in a compressor pump body according to an embodiment of the disclosure.

The enlargement portion 12 is provided on the first surface 11 or the second surface, that is, on one side of the main body 10 (as shown in FIG. 2). The enlargement portion 12 is also provided on the first surface 11 and the second surface, that is, on both sides of the main body 10 (as shown in FIG. 3 and FIG. 6). The enlargement portion 12 continuously extends from the first surface 11 to the second surface, which can greatly simplify the processing and manufacturing process of the sliding vane 1, especially when the sliding vane 1 is formed by turning.

As-some specific embodiments of the enlargement portion 12, the main body 10 is also provided with a third surface 13 and a fourth surface which are located in its rotation direction and are opposite to each other. The enlargement portion 12 includes a protruding portion 14 protruding out of the third surface 13 and/or the fourth surface, that is, the protruding portion 14 either separately protrude out of the third surface 13 or the fourth surface, or simultaneously protrude out of the third surface 13 and the fourth surface; in this case, the area of covering the first flange 3 or the second flange is larger, but the processing requirement for the corresponding part of the rotating wheel 5 is higher. Certainly, the enlargement portion 12 further includes a contact portion 15. The contact portion 15 forms a linear contact with the inner wall of the cylinder block 2 of the compressor pump body, which can greatly ensure the airtightness between the sliding vane 1 and the cylinder block 2, reduce a sliding friction force between the two, and increase the service life of the sliding vane 1.

As mentioned above, the compressor pump body further includes a rotating wheel 5. A sliding groove 51 is formed in the rotating wheel 5 for accommodating the sliding vane 1 and guiding the sliding of the sliding vane 1. The opening of the sliding groove 51 is provided with an accommodating portion 52 to accommodate the enlargement portion 12. When the compressor pump body runs, the sliding vane 1 closely abuts against the inner wall of the cylinder block 2 under the guidance of the sliding groove 51, the centrifugal force of the rotating wheel 5 and the high pressure oil in the sliding groove 51, and with the rotation of the rotating wheel 5 (the rotation axis of the rotating wheel 5 is offset with the axis of the cylinder block 2), the sliding vane 1 slides to and fro in the sliding groove 51. When the enlargement portion 12 of the sliding vane 1 moves towards the rotating wheel 5, the end face of the enlargement portion 12 (that is, the contact portion 15) should be embedded in the peripheral wall of the rotating wheel 5, so as to keep a compression clearance as small as possible, and the accommodating portion 52 can well solve the problem. In order to reduce the compression clearance as much as possible and ensure the realization of the assembly process, the assembling clearance between the enlargement portion 12 and the accommodating portion 52 is δ, and $0<\delta\leq 2$ mm, further, $0<\delta\leq 1$ mm, and further 0.1 mm$\leq\delta\leq$0.5 mm.

Further, the shape of any cross section of the enlargement portion 12 in the radial direction of the first flange 3 is any suitable shape, such as polygon, ellipse and abnormity without fixed shape characteristics, and it can be circle. The shape of the exhaust port is circular. The use of the circular enlargement portion 12 and the corresponding circular exhaust port can greatly facilitate the processing of the enlargement portion 12 and the exhaust port.

The cylinder block 2 can adopt a traditional cylinder block structure, or a rolling bearing can be used to realize the function of the cylinder block 2; in this case, the inner wall of a bearing inner race of the rolling bearing is equal to the inner wall of the cylinder block 2. When the compressor pump body runs, the bearing inner race can convert the relative sliding between the enlargement portion 12 of the sliding vane 1 and the inner wall of the bearing inner race into the rolling motion of the bearing inner race, thus reducing the mechanical power consumption of the compressor pump body and improving the energy efficiency of the compressor pump body and the compressor.

The disclosure also provides a compressor, which includes the compressor pump body. The size of the exhaust port can be increased by using the sliding vane with the enlargement portion, so as to reduce the exhaust velocity and the exhaust loss, improve the energy efficiency of the compressor, and reduce the production cost.

The disclosure also provides an air conditioner, which includes the compressor. The size of the exhaust port can be increased by using the sliding vane with the enlargement portion, so as to reduce the exhaust velocity and the exhaust loss, improve the energy efficiency of the compressor, and reduce the production cost.

It will be readily understood by those skilled in the art that the above various favorable methods can be freely combined and superimposed without conflict.

The above are embodiments of the disclosure and not intended to limit the disclosure. Any modifications, equivalent replacements, improvements and the like made within the spirit and principle of the disclosure shall fall within the scope of protection of the disclosure. The above are embodiments of the disclosure. It should be indicated that, on the premise of not departing from the technical principles of the disclosure, those of ordinary skill in the art can also make a number of improvements and variations, and these improvements and variations should fall within the protection scope of the disclosure.

What is claimed is:

1. A compressor pump body, comprising a sliding vane, a first flange and a second flange;

the sliding vane comprises a main body;

the main body is provided with a first surface and a second surface arranged opposite to the first surface;

the first surface abuts against the first flange, and the second surface abuts against the second flange;

the first surface is provided with an enlargement portion, or the second surface is provided with an enlargement portion, or the first surface and the second surface are provided with enlargement portions;

an exhaust port is formed in the first flange or an exhaust port is formed in the second flange, or exhaust ports are formed in the first flange and the second flange;

when the sliding vane rotates to sweep the exhaust port, the enlargement portion is able to prevent two sides of the sliding vane in a rotation direction from communicating by means of the exhaust port.

2. The compressor pump body as claimed in claim 1, wherein the enlargement portion continuously extends from the first surface to the second surface.

3. The compressor pump body as claimed in claim 1, wherein the main body is further provided with a third surface and a fourth surface which are in the rotating direction and arranged opposite to each other; the enlargement portion comprises a protruding portion which protrudes out of the third surface or the fourth surface or the third surface and the forth surface.

4. The compressor pump body as claimed in claim 3, further comprising a cylinder block; the enlargement portion further comprises a contact portion, and the contact portion forms a linear contact with an inner wall of the cylinder block.

5. The compressor pump body as claimed in claim 1, further comprising a rotating wheel;

a sliding groove is formed in the rotating wheel for accommodating the sliding vane and guiding the sliding of the sliding vane; and an opening of the sliding groove is provided with an accommodating portion to accommodate the enlargement portion.

6. The compressor pump body as claimed in claim 5, wherein an assembling clearance between the enlargement portion and the accommodating portion is δ, and $0<\delta\leq 2$ mm.

7. The compressor pump body as claimed in claim 6, wherein 0.1 mm$\leq$6$\leq$0.5 mm.

8. The compressor pump body as claimed in claim 1, wherein each of cross sections of the enlargement portion in a radial direction of the first flange is circular, and a shape of the exhaust port is circular.

9. A compressor, comprising the compressor pump body as claimed in claim 1.

10. An air conditioner, comprising the compressor as claimed in claim 9.

11. The compressor as claimed in claim 9, wherein the enlargement portion continuously extends from the first surface to the second surface.

12. The compressor as claimed in claim 9, wherein the main body is further provided with a third surface and a fourth surface which are in the rotating direction and arranged opposite to each other; the enlargement portion comprises a protruding portion which protrudes out of the third surface or the fourth surface or the third surface and the fourth surface.

13. The compressor as claimed in claim 12, further comprising a cylinder block; the enlargement portion further comprises a contact portion, and the contact portion forms a linear contact with an inner wall of the cylinder block.

14. The compressor as claimed in claim 9, further comprising a rotating wheel;

a sliding groove is formed in the rotating wheel for accommodating the sliding vane and guiding the sliding of the sliding vane; and an opening of the sliding groove is provided with an accommodating portion to accommodate the enlargement portion.

15. The compressor as claimed in claim 14, wherein an assembling clearance between the enlargement portion and the accommodating portion is δ, and $0<\delta\leq 2$ mm.

16. The compressor as claimed in claim 15, wherein 0.1 mm$\leq\delta\leq$0.5 mm.

17. The compressor as claimed in claim 9, wherein each of cross sections of the enlargement portion in a radial direction of the first flange is circular, and a shape of the exhaust port is circular.

* * * * *